United States Patent [19]

Huebner

[11] Patent Number: 4,644,219

[45] Date of Patent: Feb. 17, 1987

[54] BEAM GENERATING SYSTEM FOR ELECTRON TUBES, PARTICULARLY TRAVELLING WAVE TUBES

[75] Inventor: Erwin Huebner, Grafing, Fed. Rep. of Germany

[73] Assignee: Siemens Aktiengesellschaft, Berlin and Munich, Fed. Rep. of Germany

[21] Appl. No.: 667,753

[22] Filed: Nov. 2, 1984

[30] Foreign Application Priority Data

Feb. 29, 1984 [DE] Fed. Rep. of Germany ..... 3407434

[51] Int. Cl.[4] ..... H01J 1/14

[52] U.S. Cl. ..... 313/270; 313/346 DC; 313/441; 313/446; 313/456; 315/3.5

[58] Field of Search ..... 313/270, 346 DC, 441, 313/446, 456, 269, 38, 42; 315/3.5

[56] References Cited

U.S. PATENT DOCUMENTS

| | | | |
|---|---|---|---|
| 2,146,365 | 2/1939 | Batchelor | 313/38 |
| 2,153,223 | 4/1939 | Young | 313/456 |
| 2,362,908 | 11/1944 | Liebmann | 313/456 |
| 3,134,042 | 5/1964 | Sato et al. | 313/270 |
| 3,385,997 | 5/1968 | Vitzthum | 313/38 |
| 3,681,641 | 8/1972 | Katz | 313/336 |
| 3,979,634 | 9/1976 | Jaillet et al. | 315/3.5 |
| 4,298,818 | 11/1981 | McCandless | 313/456 |
| 4,403,169 | 9/1983 | Blanken | 313/446 |

FOREIGN PATENT DOCUMENTS

| | | | |
|---|---|---|---|
| 1102574 | 10/1955 | France | 313/82.1 |
| 802108 | 10/1958 | United Kingdom | 313/456 |

*Primary Examiner*—David K. Moore
*Assistant Examiner*—M. Razavi
*Attorney, Agent, or Firm*—Hill, Van Santen, Steadman & Simpson

[57] ABSTRACT

A beam generating system for electron tubes, particularly travelling wave tubes, is formed of a beam shaping electrode and a dispenser cathode supported therein having an emission disk at its end face. A positional change of the dispenser cathode in the beam shaping electrode at different ambient temperatures is suppressed with the beam generating system, and thus a beam defocussing is avoided. According to the invention, the dispenser cathode is directly connected to the beam shaping electron and is connected below the emission disk by means of a radial cathode support. The beam generating system of this type is particularly employed in travelling wave tubes.

12 Claims, 2 Drawing Figures

BEAM GENERATING SYSTEM FOR ELECTRON TUBES, PARTICULARLY TRAVELLING WAVE TUBES

BACKGROUND OF THE INVENTION

The invention relates to a beam generating system formed of a beam shaping electrode and a dispenser cathode supported therein and having an emission disc at its end face.

A beam generating system comprising a beam shaping electrode and a dispenser cathode which is cylindrical in shape and comprises an end emission face formed by a porous member is known for electron beam tubes from German Letters Patent 19 63 333, corresponding to U.S. Pat. No. 3,681,641, incorporated herein by reference.

Attempts have also been made to achieve a constant position of the dispenser cathode in a Wehnelt cylinder employed as a beam shaping electrode at various operating temperatures by means of suitable material selection or material combinations of the fastening films which reside axially in the system.

The axial fastening elements of the dispenser cathode in the Wehnelt cylinder which have been employed up to now give rise to positional changes of the dispenser cathode in the Wehnelt cylinder at different ambient temperatures and thus produce a beam defocussing.

SUMMARY OF THE INVENTION

An object of the invention given a beam generating system is to suppress a positional change of the dispenser cathode in the beam shaping electrode at different ambient temperatures and to thus avoid a beam defocussing.

This object is achieved by means of a beam generating system wherein the dispenser cathode is directly connected to the beam shaping electrode below the emission disc by means of a radial cathode support. The cathode support has a plurality of slots therein so as to form alternately upward and downward webs which permit a flexing of the radial cathode support so as to prevent an axial deflection of the dispenser cathode as a result of a concave or convex deflection of the radial cathode support.

According to the invention, the dispenser cathode is directly connected to the beam shaping electrode preferably designed as a Wehnelt cylinder, and is connected thereto immediately below the emission disk. This is advantageously accomplished with the assistance of a disk into which radial slots have been punched. Given an even numbered division, webs which result are alternately deflected toward the top and toward the bottom. The expansions or contractions occurring in the radial direction given temperature fluctuations are thus absorbed by the upwardly and downwardly deflected webs. Given a symmetrical web arrangement and uniform material quality of the emission disk, heat-induced motional differences between the dispenser cathode and the Wehnelt cylinder then no longer occur in the axial direction.

DESCRIPTION OF THE PREFERRED EMBODIMENTS

Figure 1:
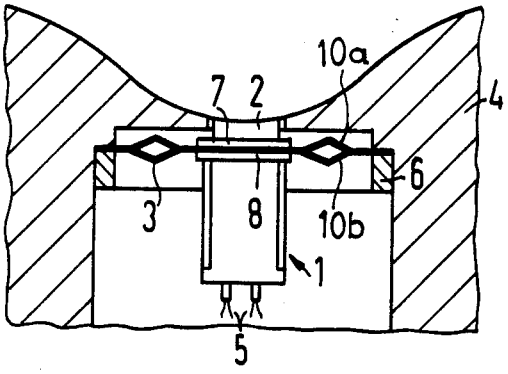
FIG. 1 schematically illustrates a beam generating system according to the invention shown partially in section.
Figure 2:
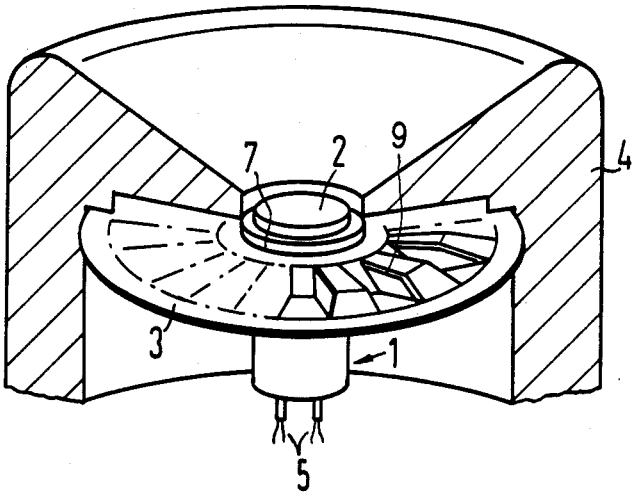
FIG. 2 schematically illustrates a side view of the beam generating system of FIG. 1 shown partially in section.

A beam generating system shown in FIGS. 1 and 2 is formed of a dispenser cathode 1 which is directly connected to the beam shaping electrode 4, and a Wehnelt cylinder connected thereto below the emission disk 2 by means of a radial cathode support 3. The terminals for indirect heating of the dispenser cathode 1 are provided with reference numeral 5. The cathode support 3 preferably has the form of a disk into which radial slots 9 have been punched. Upwardly projecting webs **10*a* and downwardly projecting webs 10*b*, given an even numbered division by slots, are alternately formed as a result of the slots 9. The dispenser cathode 1 is fastened to the disk provided with webs 10*a*, 10*b* and serves as the cathode support 3 by means of rings 7, 8. A retaining ring 6 is provided for fastening the disk in the Wehnelt cylinder (beam shaping electrode 4). Metals having a high melting point such as tantalum or molybdenum are used as the material for the disk serving as the cathode support 3**.

Although various minor changes and modifications might be suggested by those skilled in the art, it will be understood that I wish to include within the claims of the patent warranted hereon, all such changes and modifications as reasonably come within my contribution to the art.

I claim as my invention:

1. In a beam generating system for electron tubes formed of a beam shaping electrode, an emission disk with a dispenser cathode directly below the emission disk and which is supported on the beam shaping electrode, and the emission disk being at an end face of the cathode, wherein the improvement comprises:

said dispenser cathode being directly connected to said beam shaping electrode directly below said emission disk by means of a radial cathode support; and said radial cathode support having means for preventing movement of the emission disk in a direction causing beam defocusing given temperature changes of the beam generating system.

2. The beam generating system of claim 1 wherein said radial cathode support is formed of a disk into which radial slots have been punched so as to form an even division of upwardly and downwardly extending webs.

3. The beam generating system of claim 1 wherein said cathode support is formed of a metal having a high melting point.

4. The beam generating system of claim 3 wherein the metal is tantalum.

5. The beam generating system of claim 3 wherein the metal is molybdenum.

6. The beam generating system of claim 1 wherein said cathode support is formed of a disk having upwardly and downwardly extending flexing means to prevent a concave or convex deflection of the disk given temperature changes of the disk.

7. A beam generating system for electron tubes, comprising:

a beam shaping electrode, an emission disk, and a heated dispenser cathode directly below the emission disk and which is supported in a central aperture of the beam shaping electrode; and said dispenser cathode being directly connected to said beam shaping electrode by means of a radial cathode support having flexing means for preventing movement of the dispenser cathode in a direction causing beam defocussing given temperature changes at the beam generating system.

8. A system according to claim 7 wherein said means for preventing deflection comprises a plurality of upwardly and downwardly extending webs resulting from radial slits in the cathode support.

9. A travelling wave tube beam generating system, comprising:

a cylindrical Wehnelt beam shaping electrode having a central aperture;

an emission disc and a dispenser cathode directly below the emission disk disposed in the aperture, said dispenser cathode having a heater associated therewith, and the emission disk being at the end face of the cathode;

a radial cathode support attached to the dispenser cathode directly below the emission disk, a periphery of the radial disk being connected to side walls of a central aperture of the Wehnelt electrode; and said radial cathode support having means for preventing displacement in a direction causing beam defocussing given temperature changes at the beam generating system.

10. The beam generating system according to claim 9 wherein said means prevents axial movement in a primary emission direction of the dispenser cathode and comprises flexing means in the radial disk to permit expansion or contraction of the radial disk radially given a constrained periphery so as to prevent a bowing in a convex or concave direction of the radial disk.

11. A beam generating system for electron tubes, comprising:

a beam shaping electrode;

an emission disc and a dispenser cathode directly below the emission disk having a heater associated therewith, the dispenser cathode being centrally supported with respect to the beam shaping electrode;

a radial cathode supporting means between the dispenser cathode and portions of the beam shaping electrode for the central support and mounting of the dispenser cathode in a given position with respect to the beam shaping electrode; and deflection prevention means associated with the radial cathode support to prevent axial deflection of the dispenser cathode in a direction perpendicular to a plane including a major surface of the radial cathode support.

12. A system according to claim 11 wherein the radial cathode support comprises a disk having flexing means associated therewith permitting expansion and contraction of portions of the disk without causing an axial concave or convex bowing of the disk where it attaches to the dispenser cathode.

* * * * *